US011598617B2

(12) United States Patent
Agazim

(10) Patent No.: US 11,598,617 B2
(45) Date of Patent: Mar. 7, 2023

(54) MULTI-PIECE PROJECTILE WITH AN INSERT FORMED VIA A POWDER METALLURGY PROCESS

(71) Applicant: Erik Agazim, Hialeah, FL (US)

(72) Inventor: Erik Agazim, Hialeah, FL (US)

( * ) Notice: Subject to any disclaimer, the term of this patent is extended or adjusted under 35 U.S.C. 154(b) by 0 days.

(21) Appl. No.: 17/716,878

(22) Filed: Apr. 8, 2022

(65) Prior Publication Data

US 2022/0228845 A1 Jul. 21, 2022

Related U.S. Application Data

(60) Division of application No. 15/876,599, filed on Jan. 22, 2018, now Pat. No. 11,313,657, which is a continuation-in-part of application No. 15/351,025, filed on Nov. 14, 2016, now abandoned.

(51) Int. Cl.

| | |
|---|---|
| ***F42B 12/34*** | (2006.01) |
| ***F42B 12/74*** | (2006.01) |
| ***F42B 30/02*** | (2006.01) |
| ***F42B 12/36*** | (2006.01) |
| ***F42B 12/72*** | (2006.01) |

(52) U.S. Cl.

CPC ..... *F42B 12/34* (2013.01); *F42B 12/367* (2013.01); *F42B 12/72* (2013.01); *F42B 12/74* (2013.01); *F42B 30/02* (2013.01)

(58) Field of Classification Search

CPC ..... F42B 12/34; F42B 12/36; F42B 12/367; F42B 12/72; F42B 12/74; F42B 12/78; F42B 30/02

USPC ..... 102/507–510

See application file for complete search history.

(56) References Cited

U.S. PATENT DOCUMENTS

| | | | | |
|---|---|---|---|---|
| 843,017 | A | 2/1907 | Hoxie | |
| 1,493,614 | A | 5/1924 | Dickerman | |
| 1,556,160 | A | 10/1925 | Riggs | |
| 2,409,307 | A | 10/1946 | Patch | |
| 4,776,279 | A * | 10/1988 | Pejsa | F42B 12/34 102/514 |
| 4,958,572 | A | 11/1990 | Martel | |
| 5,198,616 | A | 3/1993 | Anderson | |
| 5,641,937 | A | 6/1997 | Carter | |
| 6,074,454 | A | 6/2000 | Abrams | |
| 6,186,071 | B1 | 2/2001 | Fry | |
| 6,263,798 | B1 | 7/2001 | Benini | |
| 6,536,352 | B1 | 3/2003 | Nadkarni | |

(Continued)

FOREIGN PATENT DOCUMENTS

| | | |
|---|---|---|
| DE | 2641021 | 3/1978 |
| DE | 10042719 | 3/2001 |

(Continued)

OTHER PUBLICATIONS

PCT/US2017/061587 International Search Report, dated Feb. 5, 2018.

*Primary Examiner* — James S Bergin

(74) *Attorney, Agent, or Firm* — Wolter Van Dyke Davis, PLLC; Robert L. Wolter

(57) ABSTRACT

A bullet (100), having: a main body (102) with a bore (106) bounded by a sidewall (124); an insert (104) that is disposed in the bore and that has longitudinal splines (460) configured to form a longitudinal flute (4620 in the insert and to provide radial support for the sidewall of the bore. A leading end (466) of the flute is open.

18 Claims, 11 Drawing Sheets

(56) References Cited

U.S. PATENT DOCUMENTS

| | | | | |
|---|---|---|---|---|
| 6,655,295 | B2 | 12/2003 | Baumgartner et al. | |
| 6,772,695 | B2 | 8/2004 | Kellner | |
| 6,776,818 | B1 | 8/2004 | Nilsson | |
| 6,971,315 | B2 | 12/2005 | Knappworst | |
| 7,299,750 | B2 | 11/2007 | Schikora | |
| 7,360,491 | B2 | 4/2008 | Sanborn | |
| 7,380,502 | B2 | 6/2008 | Emary | |
| 7,814,837 | B2 * | 10/2010 | Sauvestre | F42B 12/34 102/508 |
| 8,186,277 | B1 | 5/2012 | King | |
| 8,393,273 | B2 | 3/2013 | Weeks | |
| 9,003,974 | B2 | 4/2015 | Muskal | |
| 9,316,468 | B2 | 4/2016 | Rall | |
| 9,341,455 | B2 | 5/2016 | Fricke | |
| 9,709,368 | B2 * | 7/2017 | Mahnke | F42B 10/46 |
| 10,101,137 | B2 | 10/2018 | Burczynski | |
| 10,119,797 | B2 | 11/2018 | Burczynski | |
| 10,495,427 | B2 | 12/2019 | Thielen et al. | |
| 10,578,410 | B2 * | 3/2020 | Mahnke | F42B 12/74 |
| 10,677,574 | B2 | 6/2020 | Panousakis | |
| 10,690,463 | B2 | 6/2020 | Carbone et al. | |
| 10,914,560 | B2 * | 2/2021 | Masinelli | F42B 12/34 |
| 11,181,351 | B2 * | 11/2021 | Mahnke | F42B 10/26 |
| 11,313,657 | B1 * | 4/2022 | Agazim | F42B 12/74 |
| 11,428,517 | B2 * | 8/2022 | Agazim | F42B 12/06 |
| 2004/0003747 | A1 | 1/2004 | Hietanen | |
| 2006/0124022 | A1 | 6/2006 | Eberhart | |
| 2008/0264290 | A1 | 10/2008 | Salvel | |
| 2009/0308275 | A1 | 12/2009 | Nilsson | |
| 2012/0216700 | A1 | 8/2012 | Dennison | |
| 2012/0111220 | A1 | 10/2012 | King | |
| 2015/0308800 | A1 | 10/2015 | Schnabel | |
| 2016/0047638 | A1 | 2/2016 | Gallaher | |
| 2016/0097619 | A1 | 4/2016 | Emary | |
| 2016/0153757 | A1 * | 6/2016 | Mahnke | F42B 12/02 102/501 |
| 2016/0169645 | A1 | 6/2016 | Emary | |
| 2016/0223307 | A1 | 8/2016 | Bray | |
| 2017/0205215 | A1 | 7/2017 | Sloff | |
| 2017/0219325 | A1 | 8/2017 | Smith | |
| 2017/0248396 | A1 | 8/2017 | Riess | |
| 2017/0336186 | A1 | 11/2017 | Smith | |
| 2018/0094911 | A1 | 4/2018 | Fournier et al. | |
| 2018/0135950 | A1 | 5/2018 | Agazim | |
| 2021/0180927 | A1 | 6/2021 | Agazaim et al. | |

FOREIGN PATENT DOCUMENTS

| | | |
|---|---|---|
| DE | 102014224715 | 5/2016 |
| EP | 2719993 | 4/2014 |
| FR | 2867266 | 9/2005 |
| WO | 2015118173 | 8/2015 |

* cited by examiner

MULTI-PIECE PROJECTILE WITH AN INSERT FORMED VIA A POWDER METALLURGY PROCESS

This application is a divisional application of and claims benefit of the filing date of nonprovisional application Ser. No. 15/876,599 filed on Jan. 22, 2018. The subject matter of nonprovisional application Ser. No. 15/876,599 is hereby incorporated by reference in its entirety. Nonprovisional application Ser. No. 15/876,599 filed on Jan. 22, 2018 is a continuation in part of application Ser. No. 15/351,025 filed on Nov. 14, 2016. The subject matter of nonprovisional application Ser. No. 15/351,025 is hereby incorporated by reference in its entirety.

FIELD OF THE INVENTION

The invention relates to a projectile having a base body and an insert, where the insert is formed via a powder metallurgy process.

BACKGROUND OF THE INVENTION

Ammunition used by law enforcement personnel typically falls into two categories. The first includes a controlled expansion round that will not over penetrate a target. Over penetration is primary concern for law enforcement because it can cause collateral damage to bystanders. This type of ammunition will generally not defeat a barrier. The second includes a "barrier blind" cartridge which is designed to defeat a barrier such as auto glass, car doors, and the like. However, this type of ammunition may over penetrate a target if the target is not behind a barrier, which increases the risk of collateral damage. Consequently, there remains room in the art for ammunition with better controlled-penetration characteristics.

BRIEF DESCRIPTION OF THE DRAWINGS

The invention is explained in the following description in view of the drawings that show.

DETAILED DESCRIPTION OF THE INVENTION

The present inventor has devised a unique and innovative two-piece bullet having a base body and an insert, where the insert is formed via a powder metallurgy process, and optionally where the bullet includes a geometry that assists an expansion rate of the base body upon impact with a target. In an example embodiment, the powder metallurgy process is a sintering process. In an example embodiment, the insert is a partially sintered metal or metal matrix composite. In other example embodiments, the insert is a fully sintered metal or metal matrix composite. In another example embodiment, other powder metallurgy processes capable of controlling a porosity/density of an insert may be used. In an example embodiment, the main body is composed of a non-sintered metal material, e.g. the main body is a fully dense metal; a solid material. The fully dense main body may be formed by known processes, including but not limited to casting, forging, machining (e.g. from bar stock), etc. However, the main body may likewise be sintered. In alternate embodiments, the main body may be formed via a powder metallurgy process and possess characteristics like those described above for the insert.

Those of ordinary skill in the art understand that controlling the parameters associated with the sintering process enables the artisan to control characteristics of a finished product. Characteristics known to the artisan include, but are not limited to, hardness, toughness, stiffness, and mass/porosity etc. These characteristics of the insert influence penetration and fracture characteristics associated with a bullet having the insert. Consequently, an insert manufactured via SLS can be tailored to produce bullets that meet a wide range of requirements.

In addition, in example embodiments where the main body is to expand during penetration, the insert and the main body can cooperate to use energy associated with the penetration to aid in this expansion of the main body. Consequently, the insert not only influences the penetration of the bullet, but also may aid in the expansion of the main body through a variety of mechanisms.

Figure 1A:
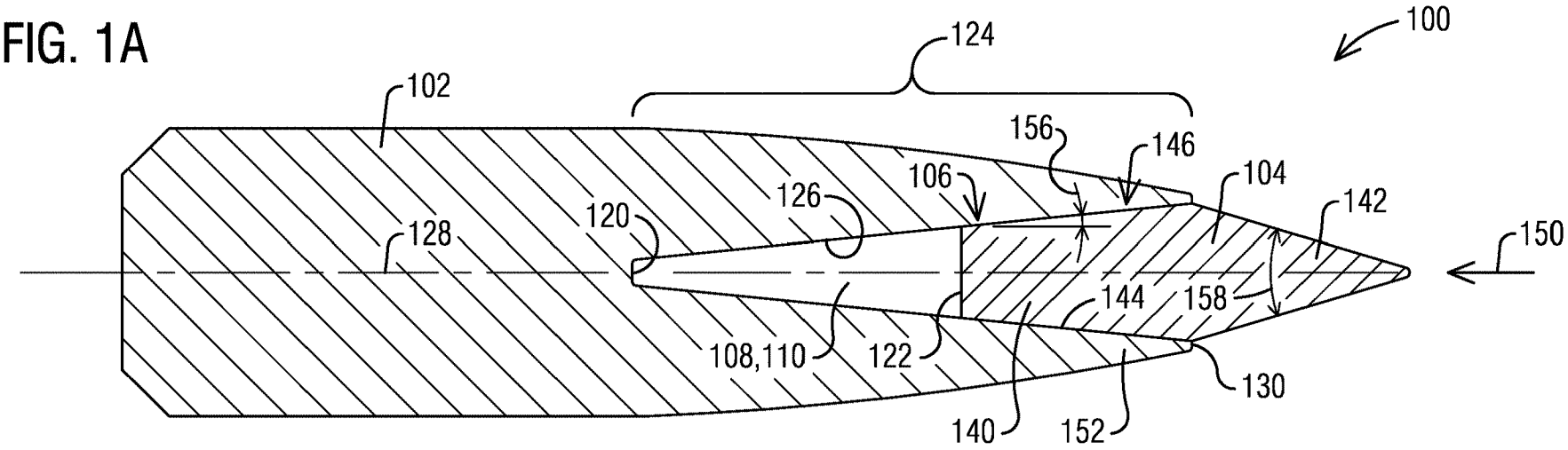
FIG. 1A is a longitudinal cross section of a bullet according to an example embodiment.

FIG. 1A is a longitudinal cross section of a bullet 100 according to an example embodiment. The bullet 100 incudes a main body 102 and an insert 104 composed of a sintered metal and disposed in a bore 106 in the main body 102, which is composed of a metal. In an example embodiment, the insert 104 is disposed in the main body 102 via an interference fit, and the degree of interference can be controlled. The main body 102 and the insert 104 cooperate to form an empty volume 108 in the form of a cavity 110 disposed between a base 120 of the bore 106 and a base 122 of the insert 104. The bore 106 includes a sidewall 124 surrounding the bore 106. In this example embodiment, the sidewall 124 includes a sidewall inner surface 126 that tapers radially inward with respect to a bullet longitudinal axis 128 from a leading edge 130 toward the base 120 of the bore 106.

The insert 104 includes an insert base 140, and an insert tip 142 that protrudes from the bore 106 past the leading edge 130 of the main body 102. In this example embodiment, the insert body 140 further includes an insert body surface 144 that tapers radially inward with respect to the bullet longitudinal axis 128 toward the base 122 of the insert 104. In an example embodiment, the insert 104 and/or the main body 102 may form an ogive shape.

In operation, the bullet 100 is fired toward a target. The target may be a hard target, a soft target, or a hard target in front of a soft target. As used herein, a hard target may be a barrier, for example, a vehicle door or a windshield. An example definition of soft target is ten percent (10%) ballistic gelatin (gel) calibrated to meet USA FBI protocol for calibrated ordnance gelatin.

In this working example, the target is a barrier followed by a soft target. The insert 104 is structurally sufficient to retain its shape and provide radially support for the sidewall 124 during impact with the barrier. The radial support counters the tendency of the sidewall 124 to buckle radially inward during impact with the barrier. Consequently, the bullet 100 passes through the barrier. In response to the impact of the bullet 100 with the barrier and subsequently with the soft target, a reactionary force is generated that acts in direction 150 on the insert 104. This moves the insert 104 farther into the bore 106, reducing a size of (i.e. deforming) the cavity 110. Stated another way, the insert 104 guides the reactionary force to the insert body surface 144, and this radially expands the sidewall 124. The taper of the sidewall inner surface 126 and the taper of the insert body surface 144 constitute cooperating elements 146 because they cooperate to radially expand the sidewall 124 in response to the movement of the insert 104 farther into the bore 106.

Figure 1B:
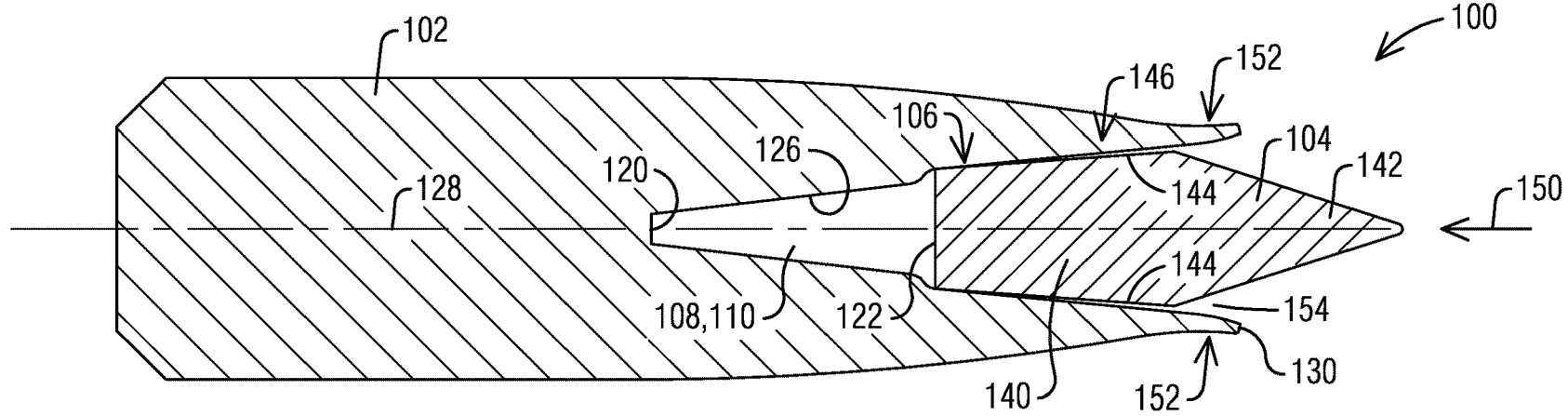
FIG. 1B is a longitudinal cross section of the bullet of FIG. 1 with the insert moved.

As can be seen in FIG. 1B, a leading end 152 of the sidewall 124 is expanded radially as the insert 104 is moved axially rearward. Soft target material then packs into an annulus 154 between the leading end 152 and the insert 104, and mechanical and hydraulic forces associated with this packing of the soft target material into the annulus 154 acts to further radially expand the sidewall 124. Upon sufficient radial expansion of the sidewall 124, the sidewall 124 becomes unable to retain the insert 104 in the bore 106. At this point the insert 104 falls away/separates from the main body 102. With the insert 104 no longer inside the bore 106, the bore 106 is fully exposed to soft target material and begins to rapidly expand radially due to the mechanical and hydraulic forces until fully expanded. In an example embodiment, the insert 104 is disposed in the bore 106 via an interference fit with the sidewall 124, and the degree of interference can be controlled to control a retention force that holds the insert 104 in the bore 106.

Figure 3:
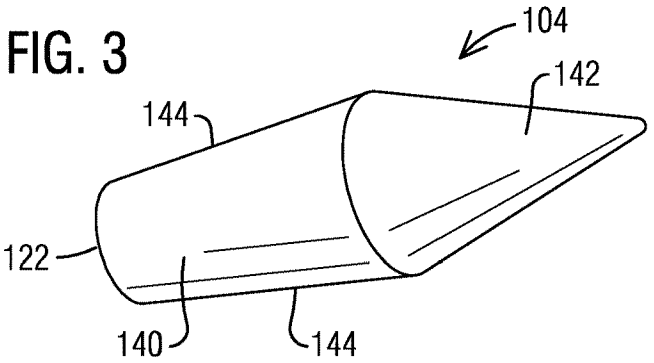
FIG. 3 is a perspective view of the insert of FIG. 2.
Figure 2:
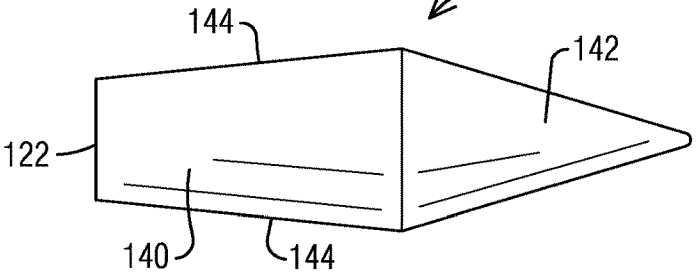
FIG. 2 is a side view of an insert of the bullet of FIG. 1.

Alternately, or in addition to falling away, the insert 104 may fracture/fragment into two or more pieces upon and/or after impact, thereby facilitating the radial expansion of the sidewall 124. Stated another way, in an example embodiment, the insert 104 is frangible, and in another example embodiment, the insert 104 is not frangible. FIGS. 2 and 3 show the insert 104 in side and perspective views respectively.

The geometric characteristics of the insert 104 can tailored to control how responsive the insert 104 is to the reactionary force. For example, a taper angle 156 can be adjusted, as can a diameter of the insert 104 and a geometry of the tip 142, including a tip angle 158 and whether the tip is pointed as shown, or blunted. In various example embodiments, the tip angle 158 may range from ninety (90) degrees to fifty (50) degrees.

Additionally, the physical characteristics related to the sintering process can also be controlled. For example, the density can be increased to increase the inserts ability to penetrate the barrier (via increased momentum), or decreased to cause the insert to fall away relatively sooner. The toughness could be increased to improve the likelihood that the insert 104 remain intact, or the toughness could be decreased to improve the likelihood that the insert will fragment. Accordingly, a balance can be struck and adjusted between those characteristics associated with improved penetration of the barrier, and those characteristics associated with rapid expansion and associated deceleration in the soft target, which can be in conflict with each other. When properly optimized, the bullet 100 can readily penetrate the barrier and then quickly decelerate in the soft target. This optimization is made possible via the sintering process and optionally by control the insert geometry, and provides an amount of control over the characteristics of the bullet 100 not seen in the prior art.

In an example embodiment, the insert 104 is formed via sintering from a powder mixture comprising copper powder and tin powder to produce a sintered insert 104 composed or a metal matrix composite. In an example embodiment, once sintered, the insert 104 exhibits a density of less than 8.7 grams/cubic centimeter. In an example embodiment, the insert 104 exhibits a density of 7.1 to 7.3 grams/cubic centimeter. In another example embodiment, the insert 104 is composed of tungsten or a steel alloy.

Figure 4:
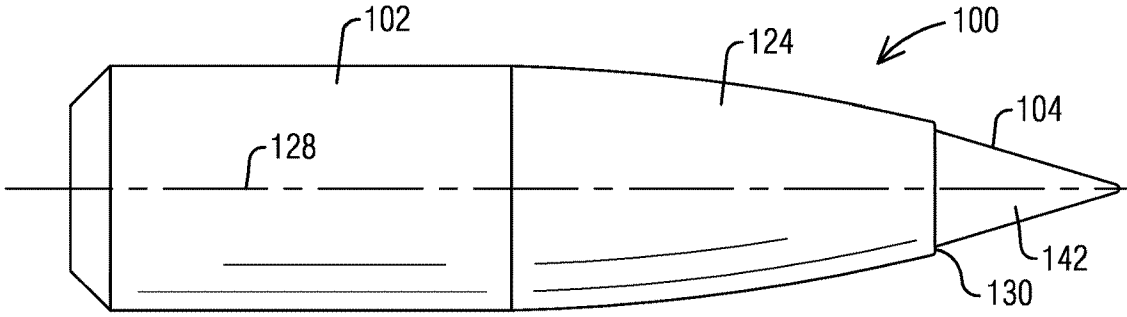
FIG. 4 is a side view of the bullet of FIG. 1A.
Figure 5:
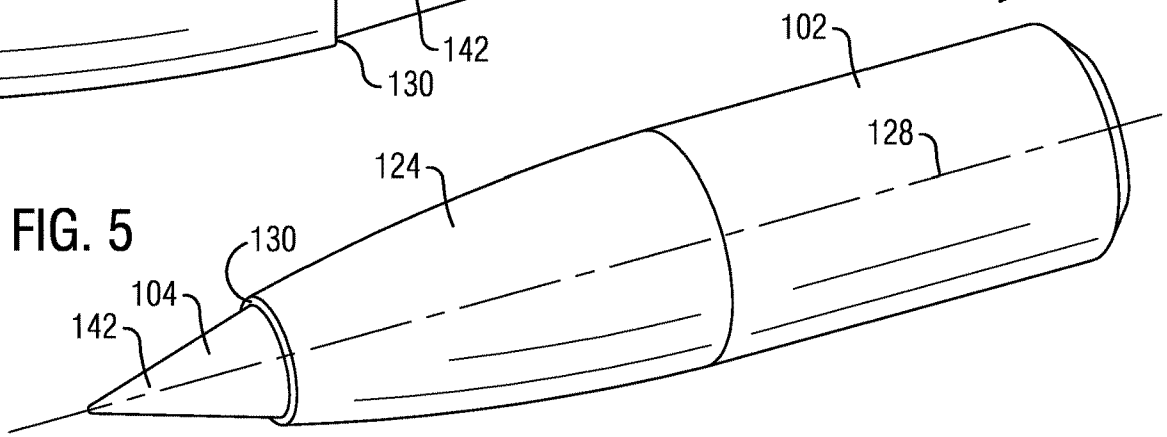
FIG. 5 is a perspective view of the bullet of FIG. 1A.

FIGS. 4 and 5 are a side view and a perspective view respectively of the bullet of FIG. 1A.

While the insert base 140 is depicted as having a circular cross section, any suitable shape can be used. For example, the insert base 140 could have a cross sectional shape of a polygon. For example, the insert base 140 could have a triangular, a square, a pentagonal, or a hexagonal cross section etc. Further, the sides and angles of the polygon may or may not be equal.

Figure 6:
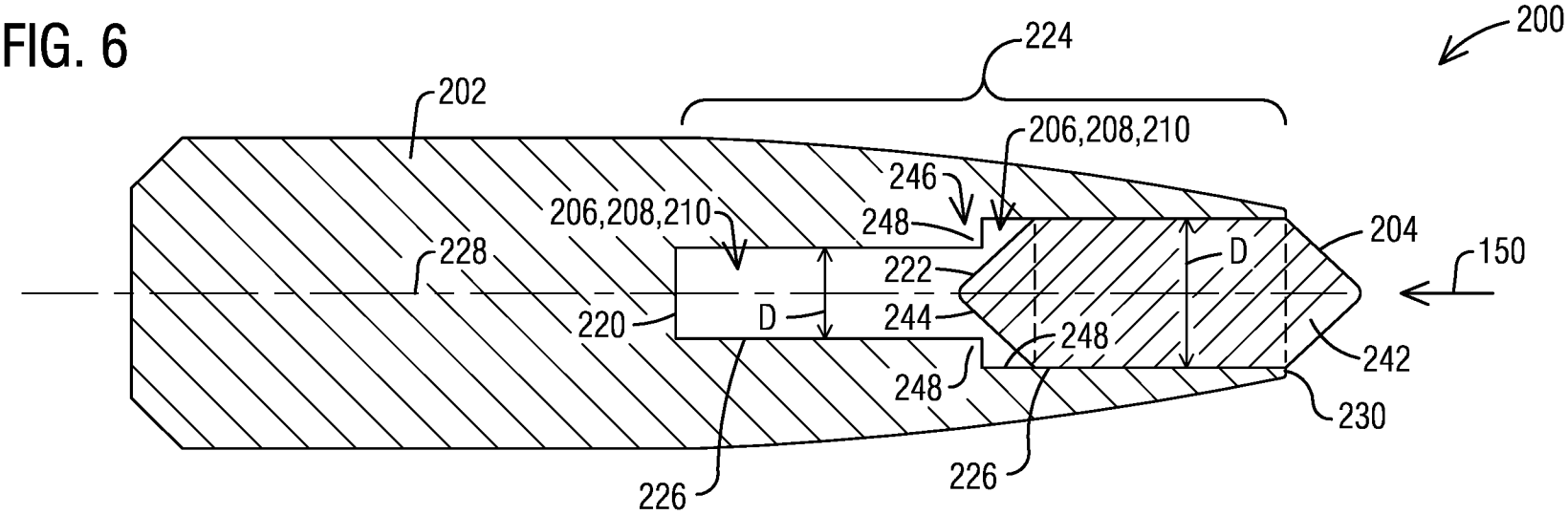
FIG. 6 is a longitudinal cross section a bullet according to another example embodiment.

FIG. 6 is a longitudinal cross section a bullet 200 according to another example embodiment. The bullet 200 incudes a main body 202 and an insert 204 composed of a sintered metal and disposed in a bore 206 in the main body 202, which is composed of a metal. The main body 202 and the insert 204 cooperate to form an empty volume 208 in the form of a cavity 210 disposed between a base 220 of the bore 206 and a base 222 of the insert 204. The bore 206 includes a sidewall 224 surrounding the bore 206. In this example embodiment, the sidewall 224 includes a sidewall inner surface 226.

The insert 204 includes the insert base 222, and an insert tip 242 that may protrude from the bore 206 past the leading edge 230 of the main body 202. In this example embodiment, the insert 204 further includes an insert body surface 244 that tapers radially inward with respect to the bullet longitudinal axis 228 toward the base 222 of the insert 204. The sidewall 224 surrounding the bore 206 includes a step 248 that decreases a diameter D of the bore 206 from a leading edge 230 toward the base 220 of the bore 206.

Figure 8:
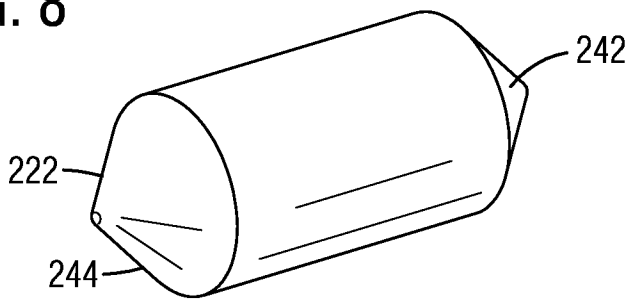
FIG. 8 is a perspective view of the insert of FIG. 7.
Figure 7:
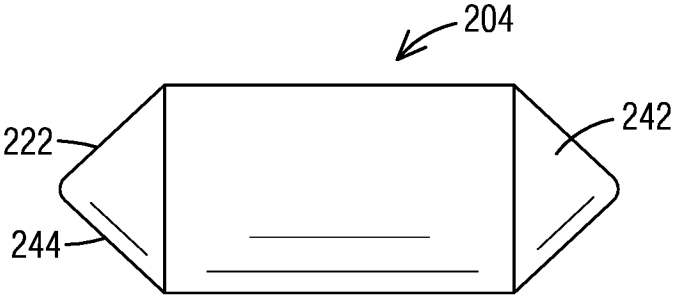
FIG. 7 is a side view of the insert of the bullet of FIG. 6.

In response to the impact of the bullet 200 with the barrier and subsequently with the soft target, the reactionary force moves the insert 204 farther into the bore 206, reducing a size of (i.e. deforming) the cavity 210. The step 248 of the sidewall inner surface 226 and the taper of the insert body surface 244 cooperate to radially expand the sidewall 224 in response to the insert's moving farther into the bore 206. The step 248 of the sidewall inner surface 226 and the taper of the insert body surface 244 constitute cooperating elements 246 because they cooperate to radially expand the sidewall 224 in response to the movement of the insert 204 farther into the bore 206. Once the insert 204 is moved farther into the bore 206, the radial expansion and falling away of the insert 204 occur similar to those processes as explained for the example embodiment of FIG. 1A. FIGS. 7 and 8 show the insert 204 in side and perspective views respectively.

Figure 9:
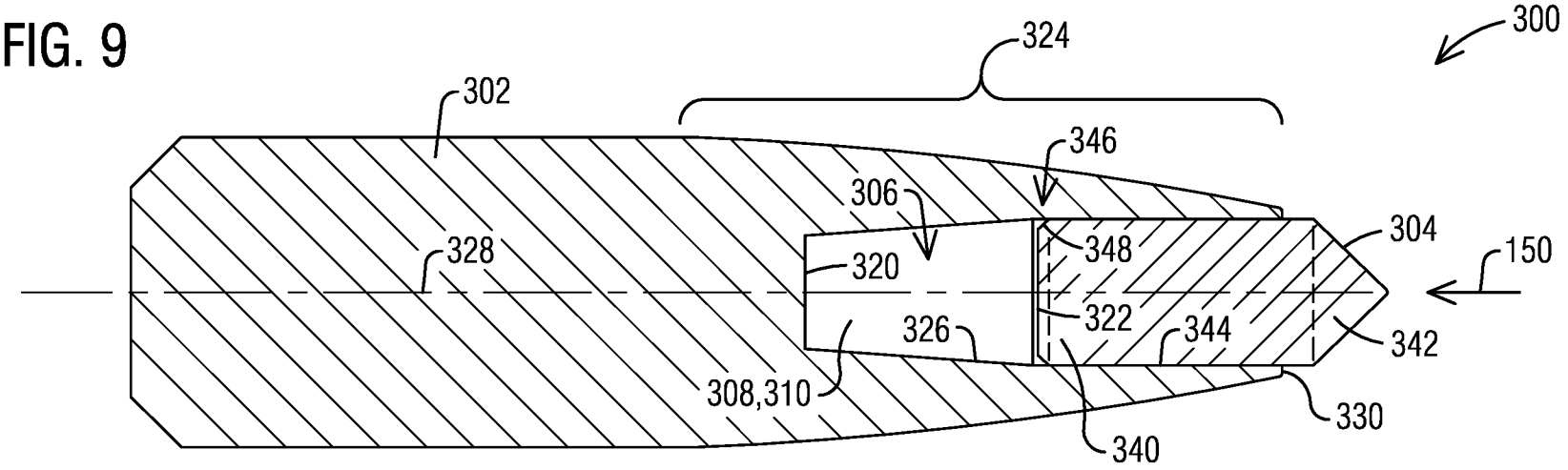
FIG. 9 is a longitudinal cross section a bullet according to another example embodiment.

FIG. 9 is a longitudinal cross section of a bullet 300 according to another example embodiment. The bullet 300 incudes a main body 302 and an insert 304 composed of a sintered metal and disposed in a bore 306 in the main body 302, which is composed of a metal. The main body 302 and the insert 304 cooperate to form an empty volume 308 in the form of a cavity 310 disposed between a base 320 of the bore 306 and a base 322 of the insert 304. The bore 306 includes a sidewall 324 surrounding the bore 306. In this example embodiment, the sidewall 324 includes a sidewall inner surface 326 that tapers radially inward with respect to a bullet longitudinal axis 328 from a leading edge 330 toward the base 320 of the bore 306. The insert 304 includes an insert base 340, and an insert tip 342 that protrudes from the bore 306 past the leading edge 330 of the main body 302. In this example embodiment, the insert base 340 further includes an insert body surface 344 that may include a chamfer 348, but which does not include a taper.

Figure 10:
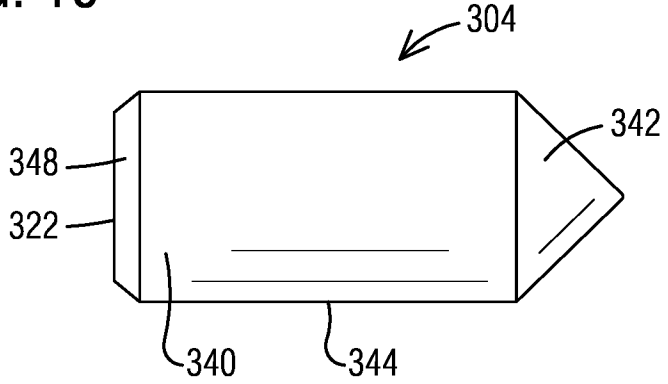
FIG. 10 is a side view of the insert of the bullet of FIG. 9.
Figure 11:
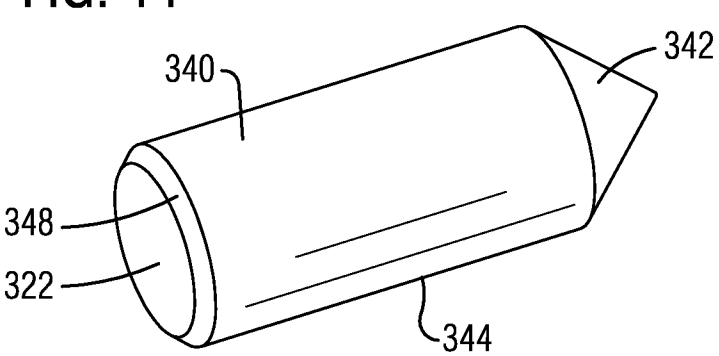
FIG. 11 is a perspective view of the insert of FIG. 10.

In response to the impact of the bullet 300 with the barrier and subsequently with the soft target, the reactionary force moves the insert 304 farther into the bore 306, reducing a size of (i.e. deforming) the cavity 310. The sidewall inner surface 326 and the insert body surface 344 cooperate to radially expand the sidewall 324 in response to the insert's moving farther into the bore 306. The taper of the sidewall inner surface 326 and the insert body surface 344 constitute cooperating elements 346 because they cooperate to radially expand the sidewall 324 in response to the movement of the insert 304 farther into the bore 306. Once the insert 304 is moved farther into the bore 306, the radial expansion and falling away of the insert 304 occur similar to those processes as explained for the example embodiment of FIG. 1A. FIGS. 10 and 11 show the insert 304 in side and perspective views respectively.

Figure 12:
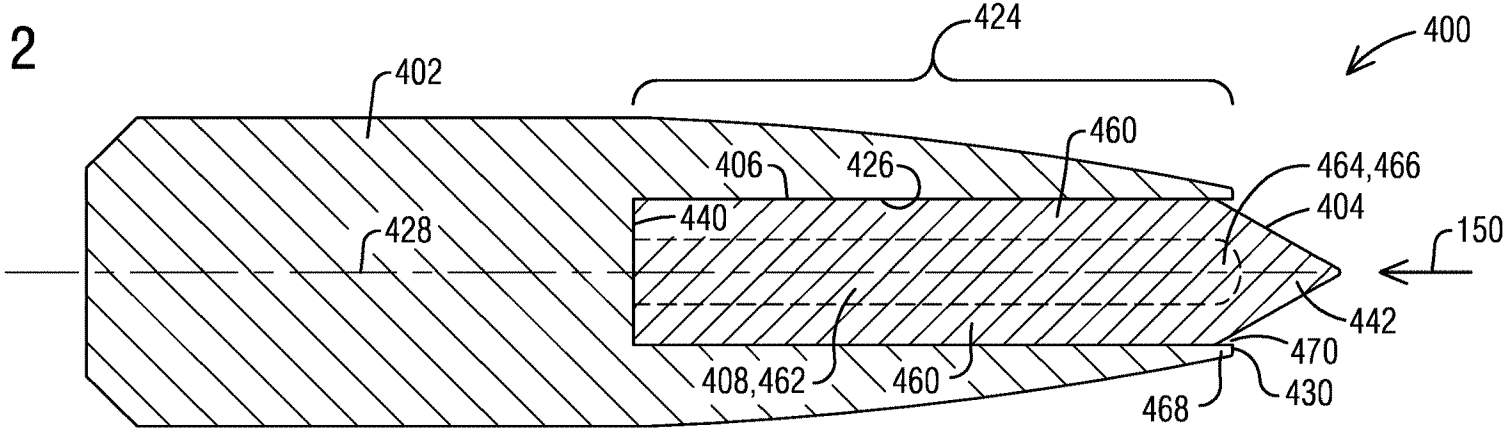
FIG. 12 is a longitudinal cross section of a bullet according to another example embodiment.

FIG. 12 is a longitudinal cross section of a bullet 400 according to an example embodiment. The bullet 400 incudes a main body 402 and an insert 404 composed of a sintered metal and disposed in a bore 406 in the main body 402, which is composed of a metal. The insert 404 includes longitudinal splines 460 that form at least one longitudinal flute 462. In the example embodiment shown, the insert 404 includes plural flutes 462 disposed in an annular array about the insert 404. There may be any number of splines 460 and flutes 462 in any embodiment. The main body 402 and the insert 404 cooperate to form an empty volume 408 in the form of the flute 462 as bounded by a sidewall inner surface 426. Each empty volume 408 includes an opening 464 at a leading end 466 of each empty volume 408. The insert 404 further includes an insert base 440, and an insert tip 442 that protrudes from the bore 406 past the leading edge 430 of the main body 402.

In this working example, the target is a barrier followed by a soft target. The splines 460 of the insert 404 are structurally sufficient to provide radially support for the sidewall 424 during impact with the barrier. The radial support counters the tendency of the sidewall 424 to buckle radially inward during impact with the barrier. Consequently, the bullet 400 passes through the barrier. In response to the impact of the bullet 400 with the barrier and subsequently with the soft target, soft target material packs into the flutes 462. Mechanical and hydraulic forces associated with this packing of the soft target material into the flutes 462 (into the empty volumes 408) radially expands the sidewall 424. Upon sufficient radial expansion of the sidewall 424, the sidewall 424 becomes unable to retain the insert 404 in the bore 406. At this point the insert 404 falls away/separates from the main body 402. With the insert 404 no longer inside the bore 406, the bore 406 is fully exposed to soft target material and begins to rapidly expand radially due to the mechanical and hydraulic forces until fully expanded. Alternately, or in addition to falling away, the insert 404 may fracture/fragment into two or more pieces upon and/or after impact, thereby facilitating the radial expansion of the sidewall 424.

In the example embodiment shown in FIG. 12, the tip 442 and the sidewall 424 are configured to form an optional lip 468. The tip 442 and the lip 468 cooperate to form an annular funnel 470 that surrounds the openings 464. The annular funnel 470 funnels the soft target material into the openings 464. This intensifies the packing of the soft target material into the empty volumes 408, which intensifies the mechanical and hydraulic forces that radially expand the sidewall 424, thereby further aiding in the radial expansion.

Figure 14:
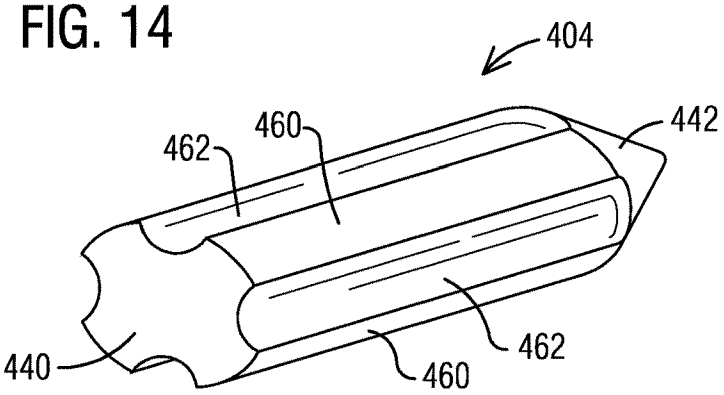
FIG. 14 is a perspective view of the insert of FIG. 13.
Figure 13:
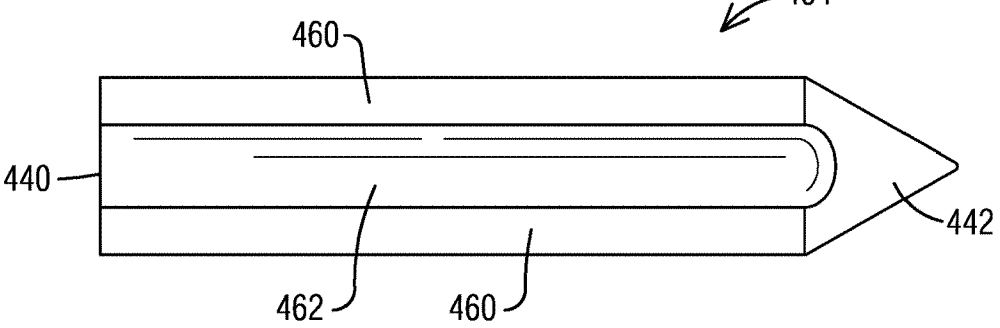
FIG. 13 is a side view of the insert of the bullet of FIG. 12.
Figure 15:
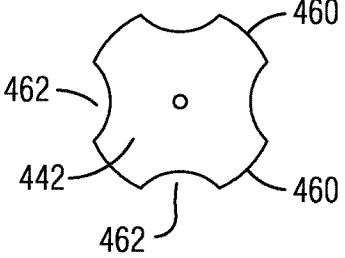
FIG. 15 is a front view of the insert of FIG. 13.

FIGS. 13, 14, and 15 show the insert 404 in side, perspective, and front views respectively.

Figure 16:
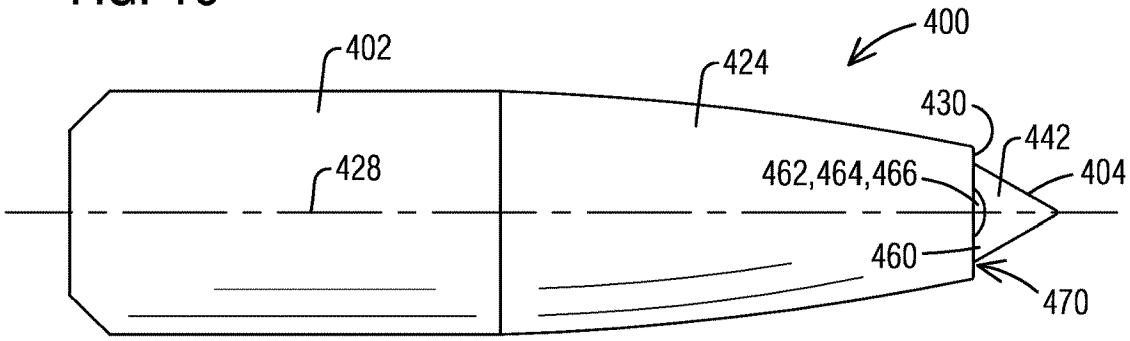
FIG. 16 is a side view of the bullet of FIG. 12.
Figure 17:
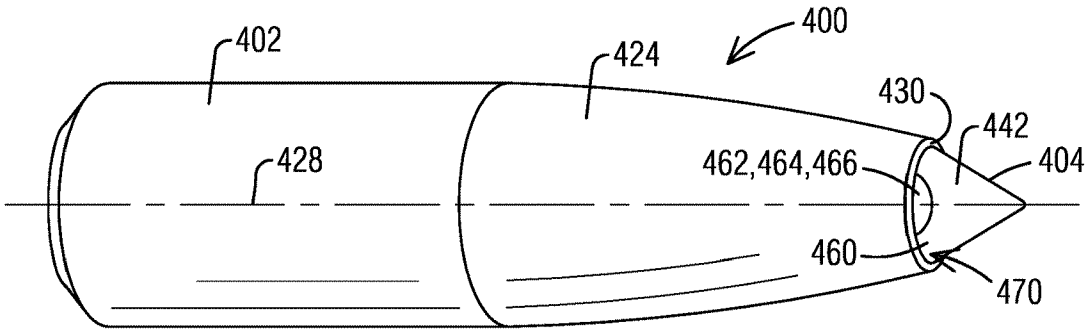
FIG. 17 is a perspective view of the bullet of FIG. 12.
Figure 18:
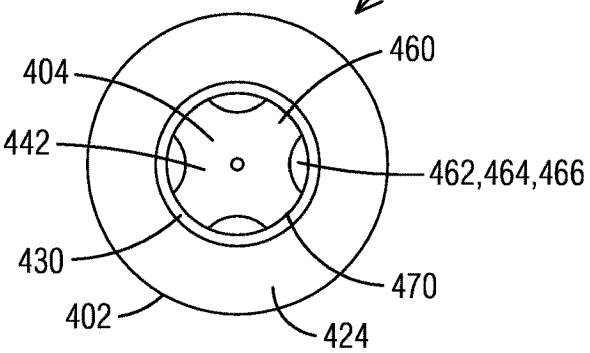
FIG. 18 is a front view of the bullet of FIG. 12.

FIGS. 16, 17, and 18 are side, perspective, and front views of the bullet 400 of FIG. 12.

Figure 19:
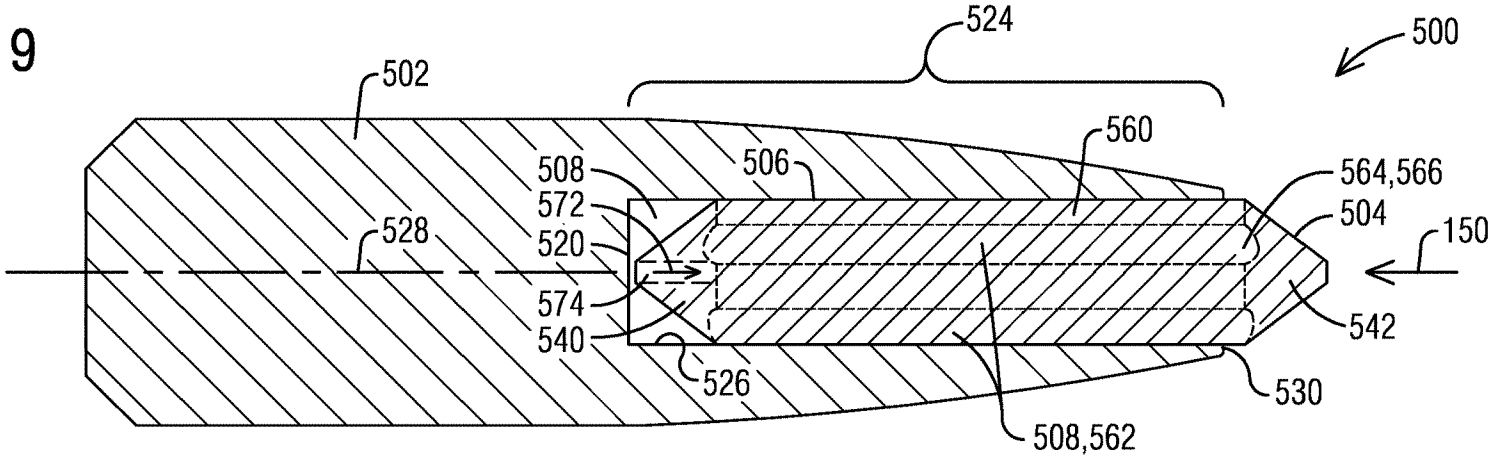
FIG. 19 is a longitudinal cross section of a bullet according to another example embodiment.

FIG. 19 is a longitudinal cross section of a bullet 500 according to an example embodiment. The insert 504 includes longitudinal splines 560 that form at least one longitudinal flute 562. In the example embodiment shown, the insert 504 includes plural flutes 562 disposed in an annular array about the insert 504. The main body 502 and the insert 504 cooperate to form an empty volume 508 in the form of the flute 562 as bounded by a sidewall inner surface 526. Each empty volume 508 includes an opening 564 at a leading end 566 of each empty volume 508. The insert 504 further includes an insert base 540, and an insert tip 542 that protrudes from the bore 506 past the leading edge 530 of the main body 502.

In this example embodiment, the insert 504 includes an insert base 540 that is tapered, as opposed to the non-tapered insert base 440 of FIG. 12. Consequently, in addition to the space inside the bore 506 between the splines 560, the empty volume 508 includes the space inside the bore 506 surrounding the insert base 540. In operation, the target material packed into the empty volume 508 between the splines 560 continues moving axially rearward along the bullet longitudinal axis 528 toward the insert base 540. This aspect of the function of the bullet 500 is similar to that of the bullet 400 of FIG. 12. However, the addition of the taper to the insert base 540 provides additional functionality.

Packed material reaching the empty volume 508 surrounding the insert base 540 assists in the radial expansion of the surrounding sidewall. Additionally, the soft target material packed in the empty volume 508 surrounding the insert base 540 increases a pressure acting on the insert base 540. This increased pressure at the insert base 540 creates a forward force that acts in direction 572. The forward force acting in direction 572 acts opposite the reactionary force acting in direction 150. Since the reactionary force tends to hold the insert 504 in the bore 506, and the forward force acts in the opposite direction, the forward force helps to unseat the insert 504 as the soft target material packs into the empty volume 508 surrounding the insert base 540 when the sidewall 524 expands radially.

Since the reactionary force is present both while impacting the barrier and the soft target, while the forward force is only present while impacting the soft target, this insert 504 is held firmly in place during penetration of the barrier, but urged out of place during the impact with the soft target. Consequently, this configuration further enables one bullet 500 to behave like two different bullets during a single shot, depending on the medium with which it is impacting. The two different behaviors are ideally suited to allow a bullet to penetrate a barrier and then stop quickly in a soft target.

Instead of the insert base 540 being tapered, the insert 504 could alternately include a flat insert base like the insert base 440 of FIG. 12, and an axially extending stem 574 or stems (shown as a dashed line) that hold the flat insert base apart from the base 520 of the bore 506. This would create a space in the empty volume 508 between the base 520 of the bore 506 and the flat insert base, and surrounding the step 574, into which soft target material would pack. The pressure created therein on the flat insert base would act normal to the flat insert base, which is parallel to the longitudinal axis 528, creating a greater forward force than is created when the pressure acts on an angled surface such as the tapered insert base 540.

Additionally, in this example embodiment, the lip 468 of FIG. 12 is not present, although it could readily be used with this example embodiment.

Figure 20:
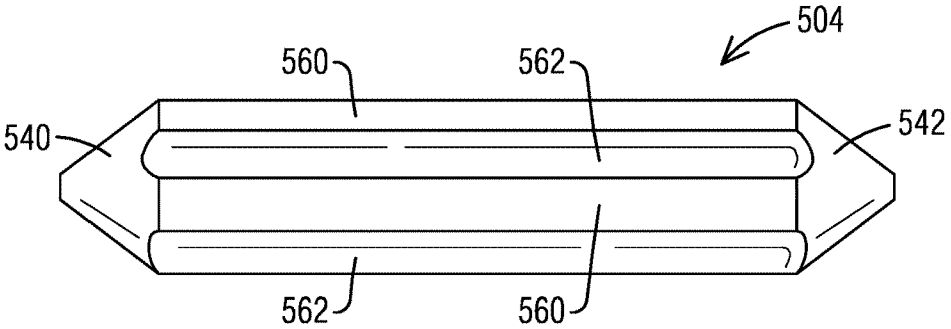
FIG. 20 is a side view of the insert of the bullet of FIG. 19.
Figure 21:
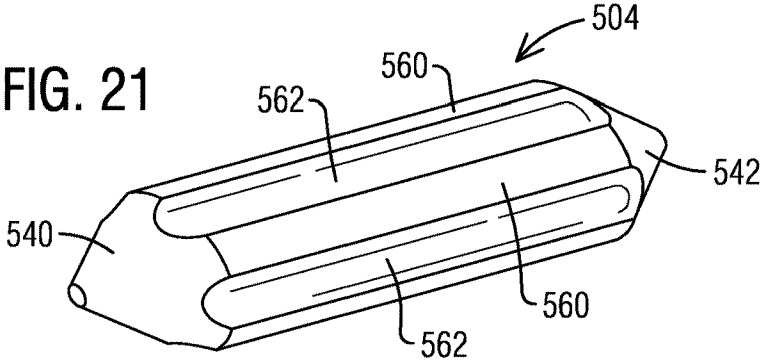
FIG. 21 is a perspective view of the insert of FIG. 20.

FIGS. 20, and 21 show the insert 504 in side and perspective views respectively.

Figure 22:
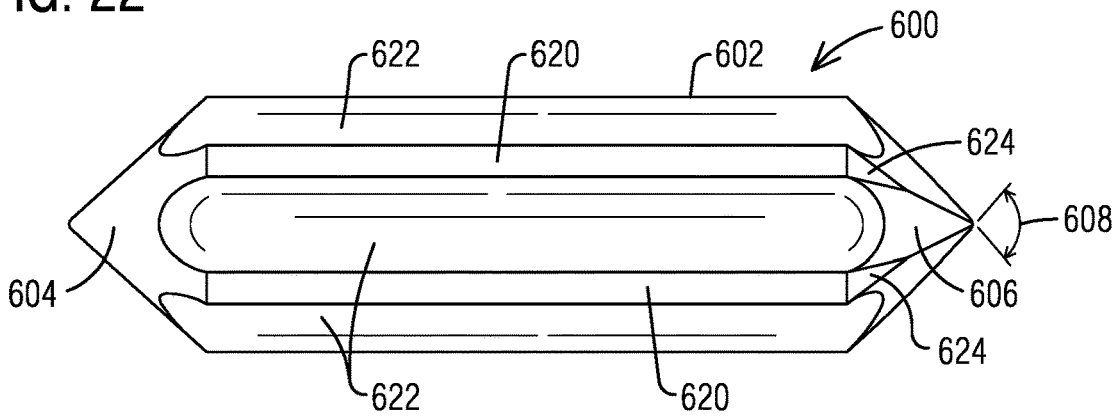
FIGS. 22-29 show view of various example embodiments of the insert.
Figure 23:
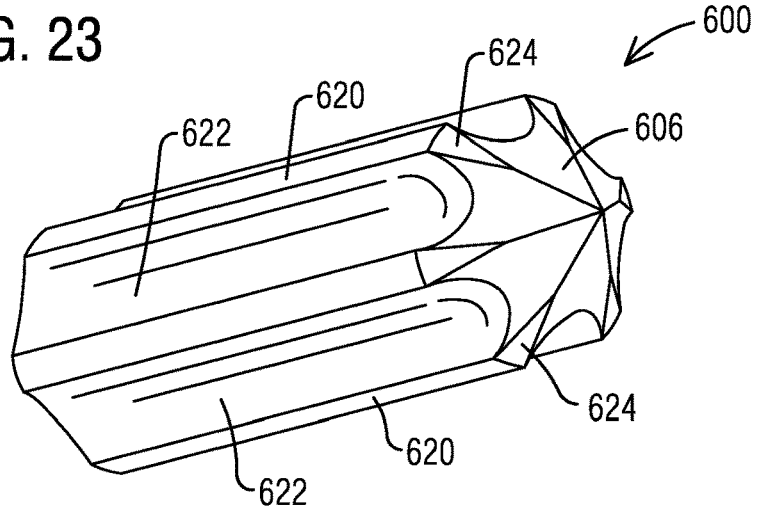
Figure 24:
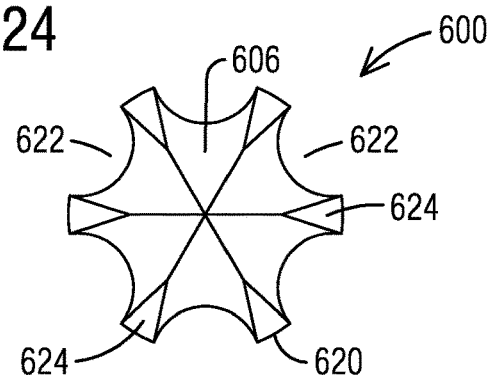

FIG. 22 is a side view of an example embodiment of an insert 600. The insert 600 includes an insert body 602 having an insert base 604 with a taper and an insert tip 606 having a tip angle 608. The tip angle 608 can be selected as desired to influence the penetration characteristics of the insert 600. The insert 600 further includes splines 620 that form flutes 622 therebetween. In this example embodiment, the splines extend farther into the insert tip 606 and incline radially inward. This geometry cooperates to form landings 624, and the configuration of the landings 624 can also be controlled to influence penetration characteristics of the insert 600. FIGS. 23-24 show the insert 600 in perspective and—front views respectively.

Figure 25:
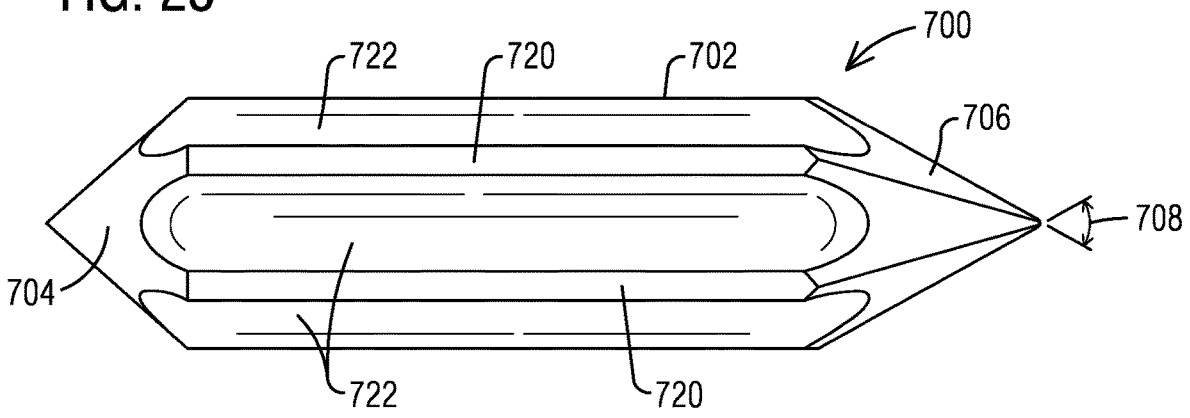
Figure 26:
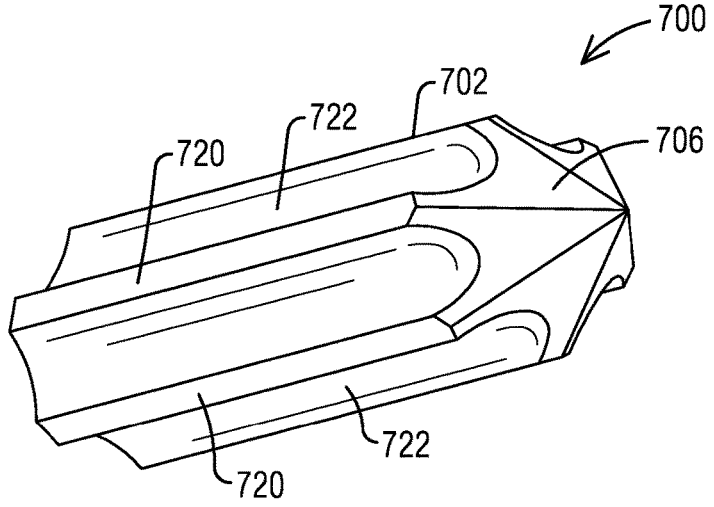
Figure 27:
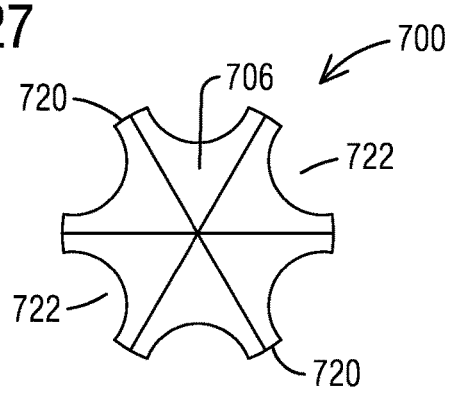

FIG. 25 is a side view of an example embodiment of an insert 700. The insert 700 includes an insert body 702 having an insert base 704 with a taper and an insert tip 706 having a tip angle 708. The tip angles 608, 708 can vary from relatively shallow, as shown in FIG. 22, to relatively sharp, as shown in FIG. 25, to influence the penetration characteristics. The insert 700 further includes splines 720 the form flutes 722 therebetween. In this example embodiment, the geometry does not form the landings present in the example embodiment of FIG. 22. FIGS. 26-27 show the insert 700 in perspective and front views respectively.

Figure 28:
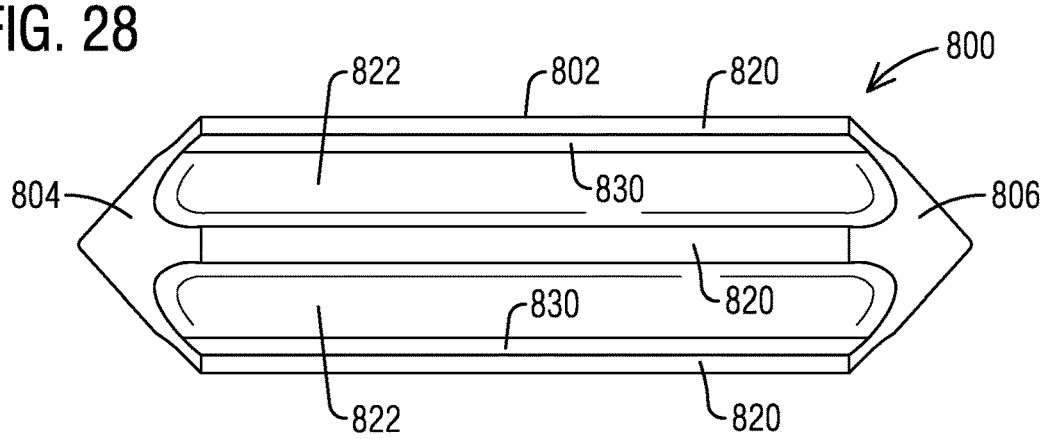

FIG. 28 is a side view of an example embodiment of an insert 800. The insert 800 includes an insert body 802, an insert base 804 having a taper, an insert tip 806, splines 820, and flutes 822 therebetween. In this example embodiment, the flutes 822 are recessed slightly deeper into the insert body 802. This forms a radially oriented flat wall 830 on the spline 820. The flutes 822 can be recessed by a selected amount to, for example, control a weight of the insert 800 and associated bullet.

Figure 29:
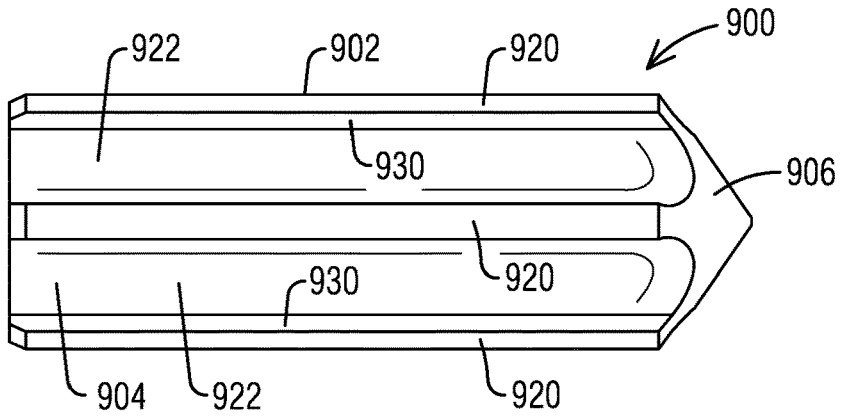

FIG. 29 is a side view of an example embodiment of an insert 900. The insert 900 includes an insert body 902, an insert base 904 without a taper, an insert tip 906, splines 920 and flutes 922 therebetween, and a radially oriented flat wall 930 on the spline 920.

Figure 30:
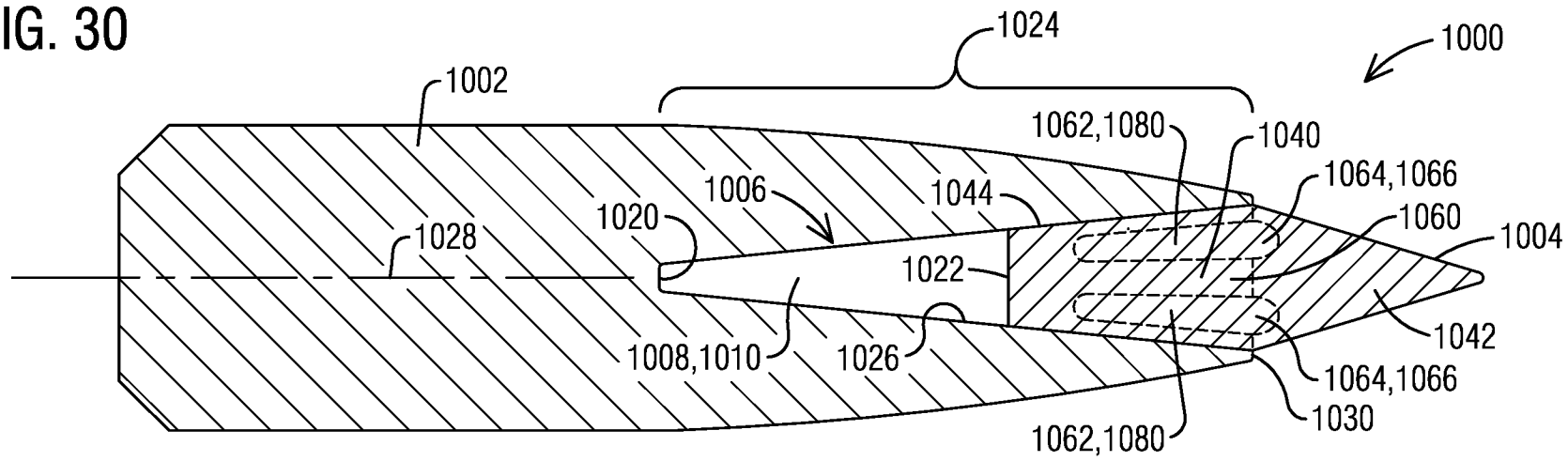
FIG. 30 is a longitudinal cross section of a bullet according to another example embodiment.

FIG. 30 is a longitudinal cross section of a bullet 1000 according to an example embodiment. The bullet 1000 incudes a main body 1002 and an insert 1004 composed of a sintered metal and disposed in a bore 1006 in the main body 1002, which is composed of a metal. The main body 1002 and the insert 1004 cooperate to form an empty volume 1008 in the form of a cavity 1010 disposed between a base 1020 of the bore 1006 and a base 1022 of the insert 1004. The bore 1006 includes a sidewall 1024 surrounding the bore 1006. In this example embodiment, the sidewall 1024 includes a sidewall inner surface 1026 that tapers radially inward with respect to a bullet longitudinal axis 1028 from a leading edge 1030 toward the base 1020 of the bore 1006.

The insert 1004 includes an insert base 1022, and an insert tip 1042 that protrudes from the bore 1006 past the leading edge 1030 of the main body 1002. In this example embodiment, the insert body 1040 further includes an insert body surface 1044 that tapers radially inward with respect to the bullet longitudinal axis 1028 toward the base 1022 of the insert 1004. The taper of the sidewall inner surface 1026 and the taper of the insert body surface 1044 cooperate to radially expand the sidewall 1024 in response to the insert's moving farther into the bore 1006. In this way, this example embodiment is like the example embodiment of FIG. 1A.

In addition to the above, the insert 1004 includes longitudinal splines 1060 that form at least one longitudinal flute 1062. In the example embodiment shown, the insert 1004 includes plural flutes 1062 disposed in an annular array about the insert 1004. The main body 1002 and the insert 1004 cooperate to form a second empty volume 1080 in the form of the flute 1062 as bounded by a sidewall inner surface 1026. Each second empty volume 1080 includes an opening 1064 at a leading end 1066 of each second empty volume 1080.

With both the tapered sidewall inner surface 1026 and the flutes 1062, this example embodiment includes two distinct features configured to aid in radially expanding the sidewall 1024. Consequently, these features can be used individually or together, as is deemed appropriate.

Figure 32:
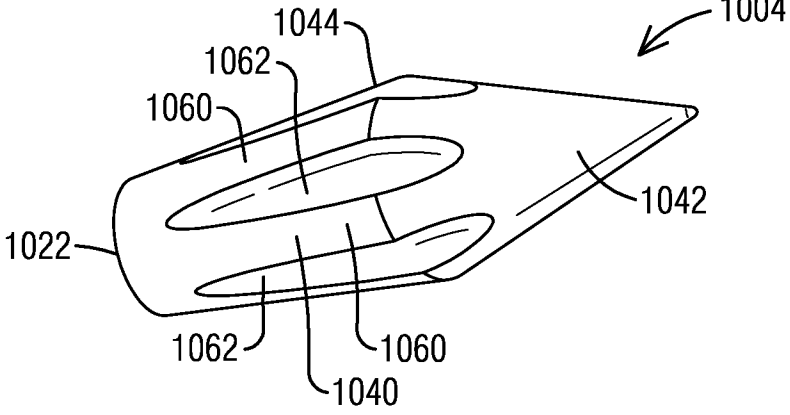
FIG. 32 is a perspective view of the insert of FIG. 31.
Figure 31:
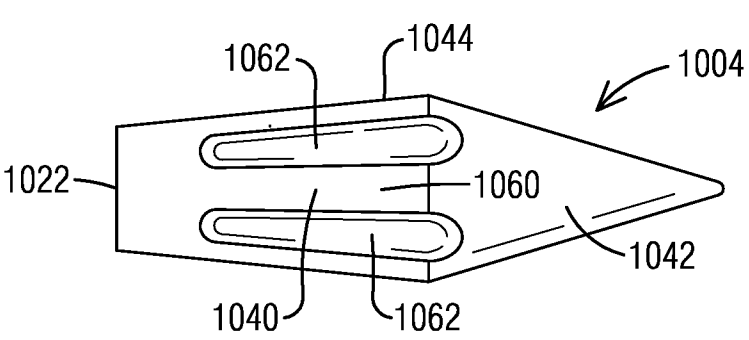
FIG. 31 is a side view of an insert of the bullet of FIG. 30.

FIGS. 31-32 show the insert 1004 in side and perspective views respectively.

Figure 33:
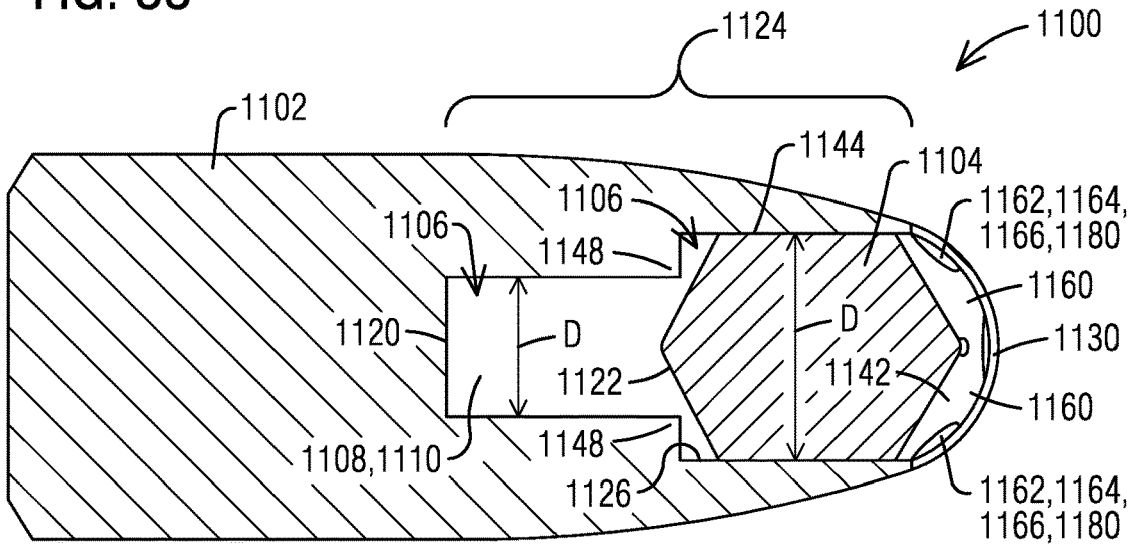
FIG. 33 is a perspective view of a longitudinal cross section of a bullet according to another example embodiment.

FIG. 33 is a perspective view of a longitudinal cross section of a bullet 1100 according to an example embodiment. The bullet 1100 incudes a main body 1102 and an insert 1104 composed of a sintered metal and disposed in a bore 1106 in the main body 1102, which is composed of a metal. The main body 1102 and the insert 1104 cooperate to form an empty volume 1108 in the form of a cavity 1110 disposed between a base 1120 of the bore 1106 and a base 1122 of the insert 1104. The bore 1106 includes a sidewall 1124 surrounding the bore 1106. In this example embodiment, the sidewall 1124 surrounding the bore 1106 includes a step 1148 that decreases a diameter D of the bore 1106 from a leading edge 1130 toward the base 1122 of the bore 1106.

The insert 1104 includes an insert base 1122, and an insert tip 1142 that protrudes from the bore 1106 past the leading edge 1130 of the main body 1102. The sidewall inner surface 1126 includes a step 1148, and the step 1148 and the insert body surface 1144 cooperate to radially expand the sidewall 1124 in response to the insert's moving farther into the bore 1106. In this way, this example embodiment is like the example embodiment of FIG. 6.

In addition to the above, the insert 1104 includes longitudinal splines 1160 that form at least one longitudinal flute 1162. In the example embodiment shown, the insert 1104 includes plural flutes 1162 disposed in an annular array about the insert 1104. The main body 1102 and the insert 1104 cooperate to form a second empty volume 1180 in the form of the flute 1162 as bounded by a sidewall inner surface 1126. Each second empty volume 1180 includes an opening 1164 at a leading end 1166 of each second empty volume 1180.

With both the step 1148 and the flutes 1162, this example embodiment also includes two distinct features configured to aid in radially expanding the sidewall 1124.

In an alternate example embodiment, the bullet may not include any empty volume, and may simply include a non-sintered main body and a sintered insert.

From the foregoing, it can be understood that the present Inventor has created a bullet that has a greater versatility than those of the prior art. The bullet disclosed herein is capable of penetrating various barriers and yet coming to a stop relatively quickly thereafter in a relatively softer target. This provides a greater degree of safety. Consequently, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A bullet, comprising:

a monolithic, metal main body that defines a long axis of the bullet, that occupies an interior volume of the bullet through which the long axis passes, and that defines a base and a side wall of a bore; and an insert that is disposed in the bore and that comprises longitudinal splines configured to form a plurality of straight flutes in the insert that are oriented parallel to the long axis of the bullet and which provides radial support for the side wall of the bore, wherein a leading end of the flute is open;

wherein the insert comprises a pointed tip and a pointed base, the pointed tip comprises a tip cone angle, the pointed base comprises a base cone angle, and the tip cone angle and the base cone angle are the same.

2. The bullet of claim 1, wherein the flutes comprise longitudinal flutes disposed in an annular array around the insert.

3. The bullet of claim 1, further comprising an empty volume between the base of the bore and the pointed base of the insert.

4. The bullet of claim 1, wherein a tapered side wall of the pointed base of the insert is set apart from and thereby free of contact with the side wall of the bore.

5. The bullet of claim 1, wherein a bitter end of the pointed base of the insert is set apart from the base of the bore and thereby does not contact the base of the bore.

6. The bullet of claim 1, further comprising a gap between a tip of the main body and the pointed tip, wherein the gap forms an annular funnel in fluid communication with the flute.

7. The bullet of claim 1, wherein the insert comprises a sintered material.

8. The bullet of claim 7, wherein the sintered material comprises a sintered composite comprising copper and tin.

9. The bullet of claim 1, further comprising cooperating elements configured to radially expand the side wall in response movement of the insert farther into the bore.

10. The bullet of claim 9, wherein the cooperating elements comprise a tapered surface disposed on at least one of the insert and an inner surface of the side wall.

11. The bullet of claim 1, wherein the pointed tip protrudes from the bore.

12. A bullet, comprising:

a monolithic main body that defines a long axis of the bullet, that forms an interior volume of the bullet through which the long axis passes, and that defines a base and a side wall of a bore; and an insert disposed in the bore and comprising an annular array of longitudinal splines configured to provide radial support for the side wall of the bore and to form an annular array of flutes in the insert, wherein a leading end of each flute of the annular array of flutes extends into a pointed tip of the insert;

wherein the insert further comprises a pointed base, the pointed tip comprises a tip cone angle, the pointed base comprises a base cone angle, and the tip cone angle and the base cone angle are the same.

13. The bullet of claim 12, further comprising cooperating elements configured to radially expand the side wall in response movement of the insert farther into the bore, wherein the insert is configured to recede into the bore as a result of an impact and while receding to cause the cooperating elements to radial expand the side wall.

14. The bullet of claim 13, wherein the cooperating elements comprise a step in the side wall and a tapered base of the insert, wherein during the movement of the insert farther into the bore the tapered base moves the step radially outward.

15. The bullet of claim 14, wherein the step in the side wall comprises a taper that matches a taper of the pointed base, and wherein the pointed base rests on the step.

16. The bullet of claim 15, further comprising a gap between a tip of the main body and the pointed tip, wherein the gap forms an annular funnel in fluid communication with each flute.

17. The bullet of claim 12, wherein the pointed tip protrudes from the bore.

18. The bullet of claim 12, wherein the insert comprises a sintered material.

* * * * *